US007140934B2

(12) United States Patent
Hoi

(10) Patent No.: US 7,140,934 B2
(45) Date of Patent: Nov. 28, 2006

(54) INTERNAL COMBUSTION ENGINE HAVING AN IMPROVED OIL PAN STRUCTURE FOR A PERSONAL WATERCRAFT, AND PERSONAL WATERCRAFT INCLUDING SAME

(75) Inventor: Yosuke Hoi, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/234,739

(22) Filed: Sep. 23, 2005

(65) Prior Publication Data

US 2006/0068656 A1 Mar. 30, 2006

(30) Foreign Application Priority Data

Sep. 29, 2004 (JP) ..... 2004-284550

(51) Int. Cl.
*B63H 20/00* (2006.01)

(52) U.S. Cl. ..... 440/88 L; 123/196 A

(58) Field of Classification Search ..... 440/88 L; 123/196 A, 196 R, 196 W
See application file for complete search history.

(56) References Cited

U.S. PATENT DOCUMENTS 4,000,666 A 1/1977 Ito et al.
4,508,069 A 4/1985 Dobler et al.
4,690,111 A 9/1987 Kohno et al.
5,483,928 A 1/1996 Mahlberg et al.
5,887,564 A * 3/1999 Kawamoto ..... 440/88 L
6,371,071 B1 4/2002 Iwata
6,508,211 B1 1/2003 Asano
6,681,708 B1 1/2004 Gokan
6,719,598 B1 * 4/2004 Gokan et al. ..... 440/88 L
6,743,063 B1 * 6/2004 Gokan ..... 440/88 L
6,772,725 B1 8/2004 Inaba et al.
6,868,816 B1 3/2005 Hiraki et al.

FOREIGN PATENT DOCUMENTS

JP 2003-035201 2/2003

* cited by examiner

*Primary Examiner*—Lars A. Olson
(74) *Attorney, Agent, or Firm*—Carrier, Blackman & Associates, P.C.; Joseph P. Carrier; William D. Blackman

(57) ABSTRACT

An internal combustion engine for a personal watercraft, the engine including an oil pan in which a lateral width and vertical width thereof are narrow, in compliance with a shape of the boat bottom of the personal watercraft, resulting in an internal combustion engine which is short in overall height. The internal combustion engine includes the oil pan connected to the underside of the crankcase and extending longitudinally along the boat bottom of the hull, the oil pan including an elongate cavity with one longitudinally extending side of the cavity being opened. An oil strainer is installed within the opening in the cavity so as to be oriented substantially vertically therein, and includes a cover which protrudes to one side. Lubricating oil is drawn through the oil strainer by action of an oil pump.

17 Claims, 12 Drawing Sheets

INTERNAL COMBUSTION ENGINE HAVING AN IMPROVED OIL PAN STRUCTURE FOR A PERSONAL WATERCRAFT, AND PERSONAL WATERCRAFT INCLUDING SAME

CROSS-REFERENCE TO RELATED APPLICATIONS

The present invention claims priority under 35 USC 119 based on Japanese patent application No. 2004-284550, filed on Sep. 29, 2004. The subject matter of this priority document is incorporated by reference herein.

BACKGROUND OF THE INVENTION

1. Field of the Invention

This invention relates to an internal combustion engine mounted on a personal watercraft for operation in water. More particularly, the invention relates to an internal combustion engine having an improved oil pan structure.

2. Description of the Background Art

The personal watercraft, or small-sized planing boat, is constructed such that an internal combustion engine for driving a jet propulsion pump is mounted in a vessel body enclosed by a hull and a deck. A driver and up to two other crew members rides on the deck, so that an in-boat space, constituted by the hull and the deck, is narrow. The internal combustion engine is stored in a substantially closed and sealed state within the narrow space between the hull and the deck.

As a consequence, a compact internal combustion engine is required. In order to minimize the height of the internal combustion engine, a dry sump having no oil reservoir for accumulating a large amount of oil is employed. Such an internal combustion engine is disclosed, for example, in published Japanese patent document JP-A 2003-35201.

The oil pan in JP-A No. 2003-35201 is not used for accumulating a large amount of oil. However, a small amount of oil is accumulated in a certain receiving pan, and the accumulated oil is sucked by an oil pump and fed to an oil tank. An oil strainer is arranged within the oil pan in tension, and is oriented substantially horizontally therein. The accumulated oil is sucked through the oil strainer whereby some foreign substances are removed from the oil.

Since the oil strainer is arranged in tension within the oil pan in a substantially horizontal orientation, a certain degree of lateral width of the oil pan is required. It is not easy to align the oil strainer in compliance with an oil pan shape, which is increasing rightward or leftward at the central part of the boat bottom of the personal watercraft. In addition, it is necessary to configure a space having a certain degree of vertical distance above and below the horizontally oriented oil strainer, and providing the required narrow vertical distance for the oil pan is difficult.

The present invention has been invented in view of the considerations described above, and it is an object of the present invention to provide an internal combustion engine for a personal watercraft in which the lateral width of the oil pan is narrow and its vertical width is also kept short, in compliance with a shape of the boat bottom part of the personal watercraft. As a result, the overall height of the internal combustion engine is kept short.

SUMMARY

In order to accomplish the aforesaid object, the internal combustion engine for the personal watercraft according to a first aspect thereof drives a jet propulsion pump and is mounted in a vessel body enclosed by a hull and a deck. The deck supports a driver thereon, and can support additional riders. The internal combustion engine is characterized in that it includes an oil pan connected from below to a lower surface of a crankcase. The oil pan is arranged along a boat bottom of said hull. One long side of the oil pan is opened in a forward or rearward direction of the vessel body by means of a frame wall that protrudes substantially in a vertical direction. The oil pan includes a cavity that communicates with an oil pump, and an oil strainer is arranged substantially in a vertical direction within said opening to partition the cavity.

A second aspect of the invention relates to the internal combustion engine for a personal watercraft of the first aspect, further characterized in that at least an upper surface of the cavity is formed by said crankcase.

A third aspect of the invention relates to the internal combustion engine for a personal watercraft of the second aspect, further characterized in that the oil strainer is held in place between, and by means of, the crankcase and the oil pan.

A fourth aspect of the invention relates to the internal combustion engine for a personal watercraft of any one of the first through third aspects, further characterized in that the internal combustion engine is mounted while being inclined to any one of right and left sides in respect to the vessel body. Moreover, an opening of the cavity is formed at a lower side of the cavity, the cavity having the oil strainer arranged therein.

In accordance with the internal combustion engine for a personal watercraft according to the first aspect of the invention, the opening is formed at one long side of the cavity so as to extend in a forward or rearward direction of the vessel body within the oil pan. The opening is defined by the oil strainer, the oil strainer being oriented substantially vertically therein. As a result, it is possible to make a lateral width of the oil pan narrow, and it is easy to align it with a rightward or leftward protruding shape formed at the central part of the boat bottom of the personal watercraft. Moreover, when the oil strainer is installed in a substantially vertical attitude, it is possible to keep a sufficient space at the right and left sides of the oil strainer even if the vertical width of the oil pan is set small, the vertical width of the oil pan itself can be reduced, and the overall height of the internal combustion engine can be set low.

In accordance with the internal combustion engine for a personal watercraft according to the second aspect of the invention, exclusive component parts are not separately required and the number of component parts can be decreased because at least the upper surface of the cavity is formed by the crankcase.

In accordance with the internal combustion engine for a personal watercraft according to the third aspect of the invention, a superior assembling characteristic is provided because the oil strainer is held in place between, and by means of, the crankcase and the oil pan.

In accordance with the internal combustion engine for a personal watercraft according to a fourth aspect of the invention, the oil strainer is installed at an opening of the cavity in the oil pan of the internal combustion engine. The internal combustion engine is mounted so as to be inclined to any one of the right and left side with respect to the watercraft body. As a result of the incline, the oil strainer is positioned within the lowest portion of the cavity, thus the oil strainer is always submerged in the oil accumulated in the oil pan, and suction of air into the lubrication system can be reduced.

Modes for carrying out the present invention are explained below by reference to an embodiment of the present invention shown in the attached drawings. The above-mentioned object, other objects, characteristics and advantages of the present invention will become apparent form the detailed description of the embodiment of the invention presented below in conjunction with the attached drawings.

DETAILED DESCRIPTION

A selected illustrative embodiment of the invention will now be described in some detail, with reference to FIGS. 1 through 17. It should be understood that only structures considered necessary for clarifying the present invention are described herein. Other conventional structures, and those of ancillary and auxiliary components of the system, are assumed to be known and understood by those skilled in the art. Further, in the description provided herein, the right and left orientation is determined with reference forward advancing direction of the watercraft body.

Figure 1:
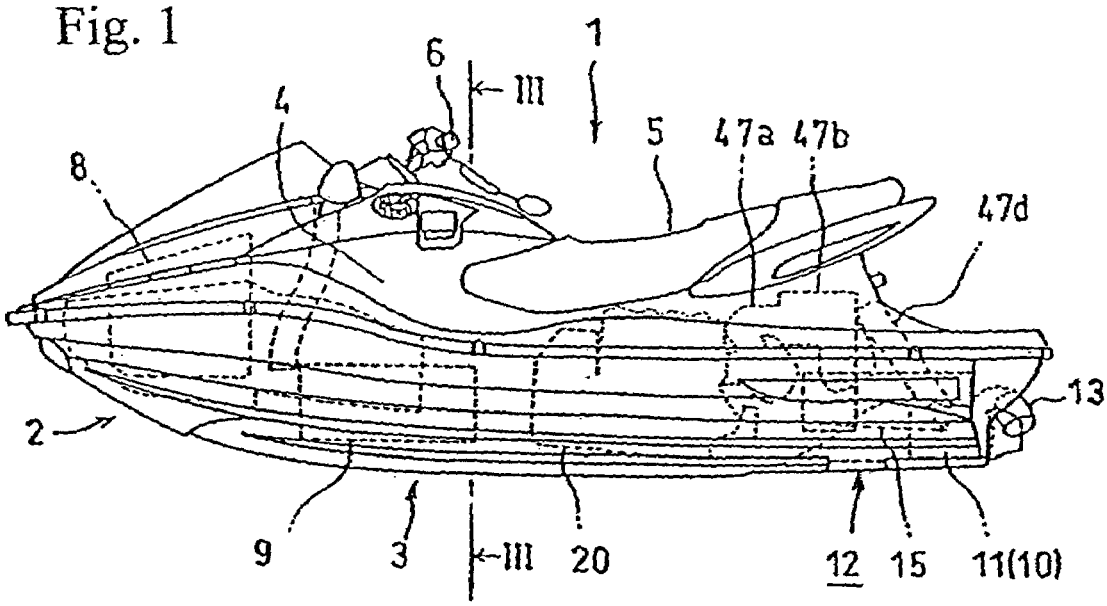
FIG. 1 is a side elevational view of a personal watercraft having the internal combustion engine of one preferred embodiment of the present invention mounted thereon below a seat.
Figure 2:
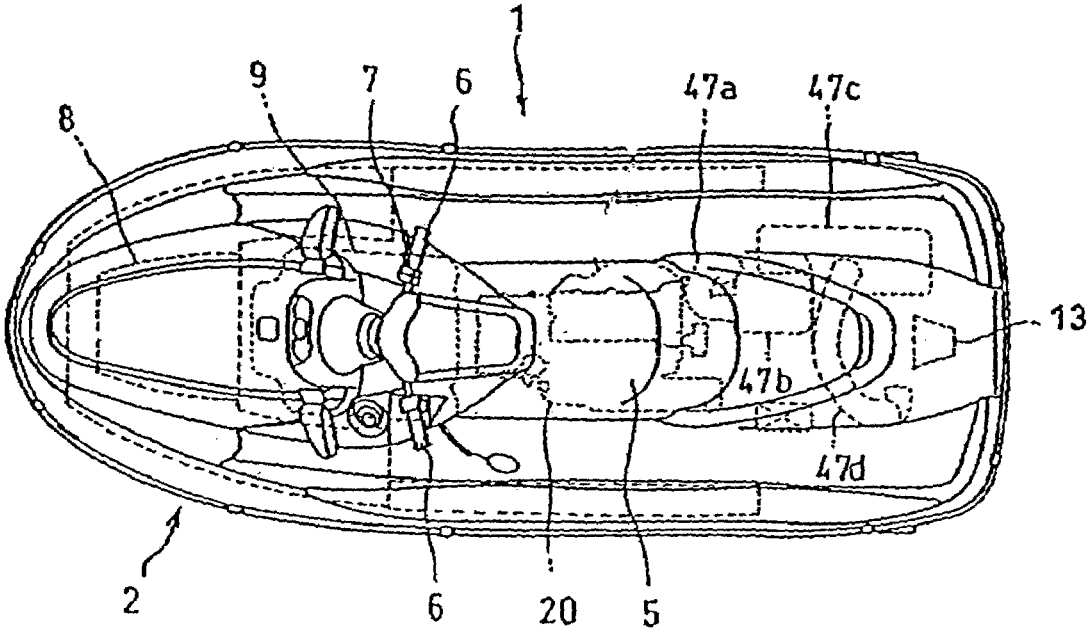
FIG. 2 is a top plan view of the personal watercraft of FIG. 1 showing the internal combustion engine mounted along the longitudinal centerline of the personal watercraft.
Figure 3:
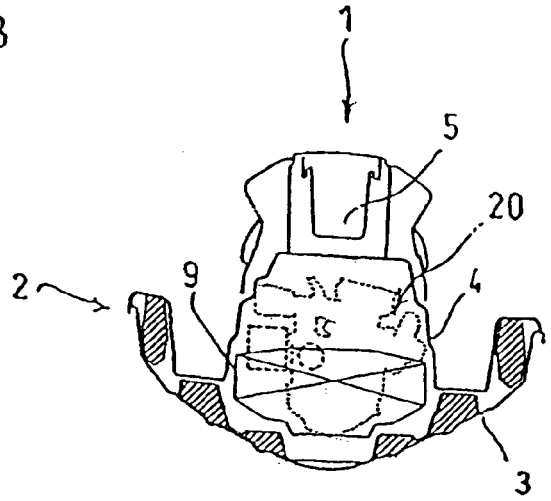
FIG. 3 is a sectional view of the personal watercraft taken along line III—III in FIG. 1 showing the engine compactly mounted between a deck on an upper side and a hull on a lower side.

A side elevational view of a personal watercraft 1 is illustrated in FIG. 1. The personal watercraft 1 has an internal combustion engine 20 mounted thereon in accordance with the preferred embodiment. FIG. 2 illustrates a top plan view of the personal watercraft 1 of FIG. 1, and FIG. 3 illustrates a sectional view of the personal watercraft 1 FIG. 1.

The personal watercraft 1 is a small-sized saddle-ride type planing boat made such that an inner space is formed by a hull 3, providing a lower boat bottom, and an upper deck 4. The hull 3 and the deck 4 constitute a vessel body 2. An internal combustion engine 20 is stored in the inner space within the vessel body 2. The personal watercraft 1 is sized such that one to three crew members may straddle a central seat 5 provided on the deck 4 of the vessel body 2, and a handlebar 6 at the front part of the seat 5 is operated to steer the boat.

A propulsion means for the personal watercraft 1 is a jet propulsion pump 10 driven by the internal combustion engine 20. The jet propulsion pump 20 is arranged at the rear part of the hull 3. The jet propulsion pump 10 is an axial pump having a structure in which an impeller 11 is installed at a flow passage ranging from a water inlet 12, opened at the underside of the boat, to a nozzle 13, arranged at the rear end of the vessel body and defining an outlet port (refer to FIG. 17). A shaft 15 of the impeller 11 is connected to a crankshaft 21 of the internal combustion engine 20 through a coupler 56.

Accordingly, when the impeller 11 is rotationally driven by the internal combustion engine 20 through the shaft 15, water which has been drawn in at the water inlet 12 is expelled outwardly from the outlet port through the nozzle 13. As a result, the vessel body 2 is propelled forwardly under its reacting action, and then, at appropriate speeds, the personal watercraft 1 planes on the water.

Propulsion force generated by the jet propulsion pump 10 is controlled through an operation of a throttle lever 7 mounted to the handlebar 6. The nozzle 13 is rotatably operated through an operating wire corresponding to a steering operation of the operating handle 6, and an advancing direction of the vehicle is changed by changing an orientation of the outlet port of the nozzle 13. The internal combustion engine 20 is arranged below the seat 5 substantially at the central part in the vessel body 2. The front part of the vessel body 2 has a storing chamber 8, and a fuel tank 9 is installed between the storing chamber 8 and the internal combustion engine 20.

The internal combustion engine 20 is an in-line four-cylinder type internal combustion engine of DOHC type 4-stroke cycle, where the crankshaft 21 is oriented in a forward or rearward (longitudinal) direction of the vessel body 2. The main body of the internal combustion engine 20 is made such that a cylinder block 22 and a crankcase 23 are vertically stacked, and are connected to each other along a split, or dividing, plane 24 in such a way that the crankshaft 21 is rotatably supported along the split plane 24. Moreover, the cylinder head 25 overlies the cylinder block 22, and the cylinder head cover 26 is applied to the upper surface of the cylinder head 25. In addition, an oil pan 27 is fixed below the crankcase 23 to the underside thereof.

Figure 6:
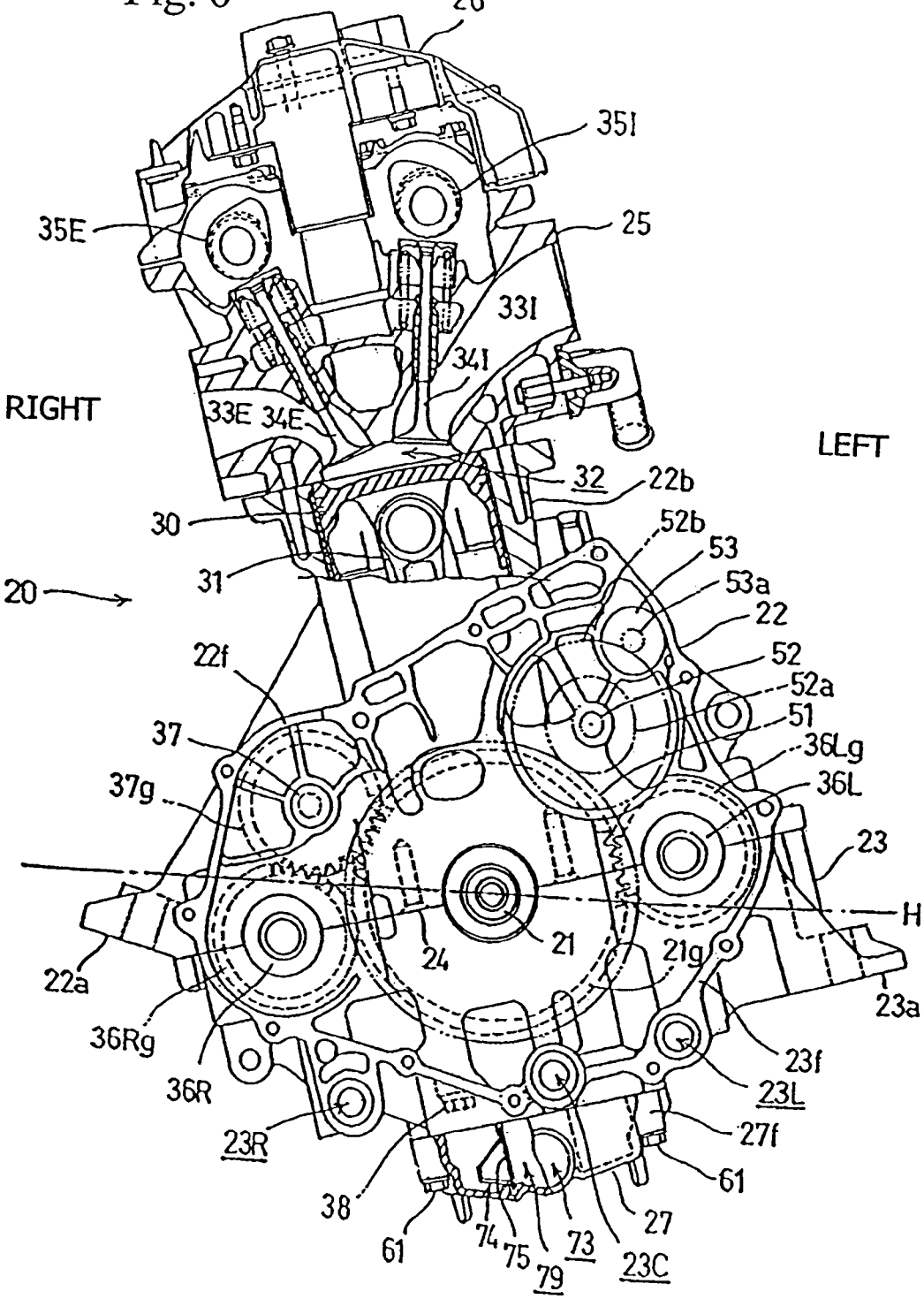
FIG. 6 is a front elevational and partially sectional view of the internal combustion engine of FIG. 1 showing a dividing, or split, plane between the cylinder block and the crankcase oriented at an acute angle with respect to a horizontal plane.
Figure 9:
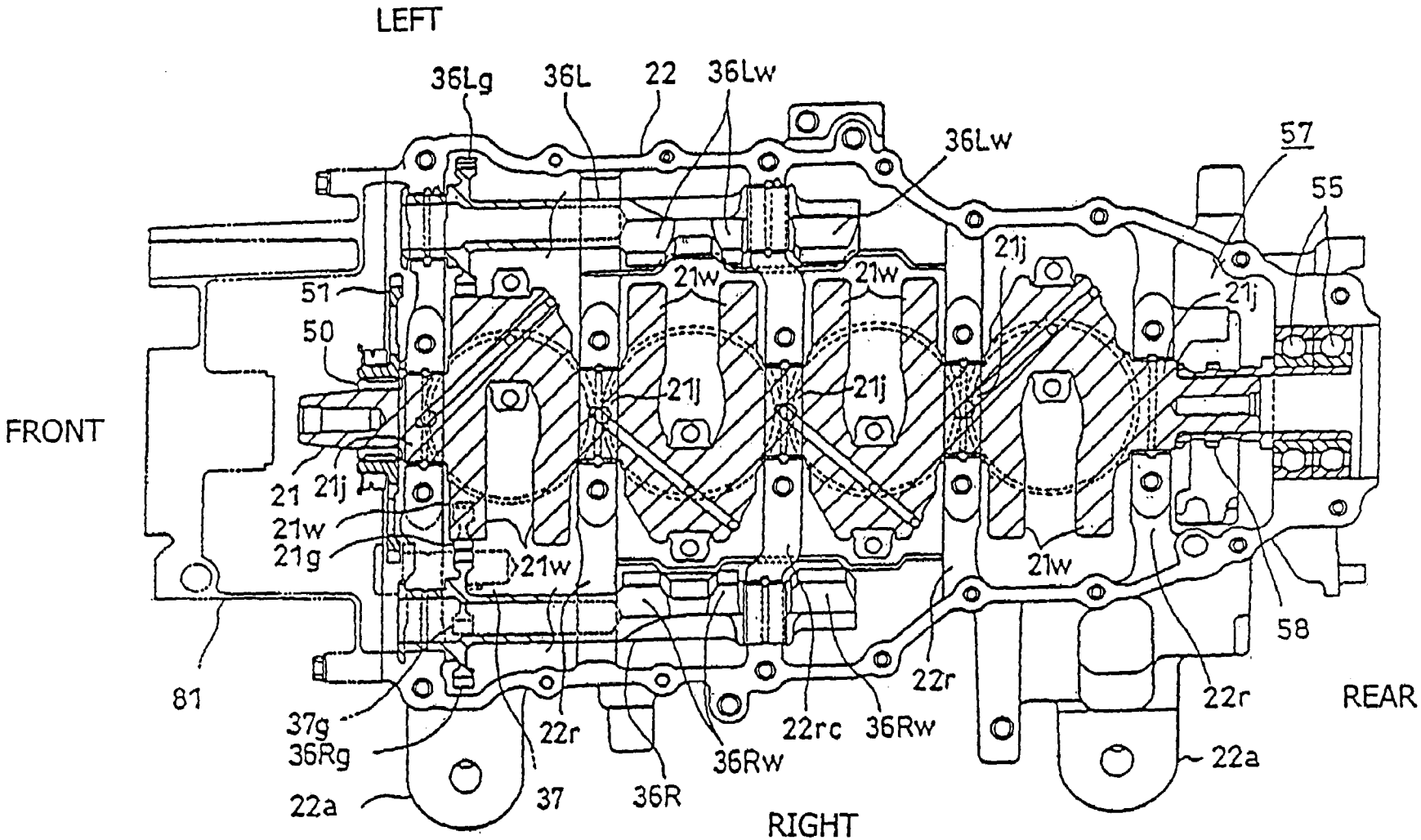
FIG. 9 is a bottom sectional view of a cylinder block of the internal combustion engine of FIG. 1 showing the configuration of the ribs formed on an interior surface of the cylinder block, and showing balancer shafts extending longitudinally along the left and right sides of a front portion of the cylinder block.

Mount brackets 22*a*, 22*a* protrude at the forward and rearward lower ends of the right side of the cylinder block 22 so as to in a slant upward (refer to FIGS. 6 and 9). Similarly, a pair of forward and rearward mount brackets 23*a*, 23*a* protruded in parallel with the split plane 24 from the left side of the crankcase 23 (refer to FIGS. 6 and 10).

Figure 4:
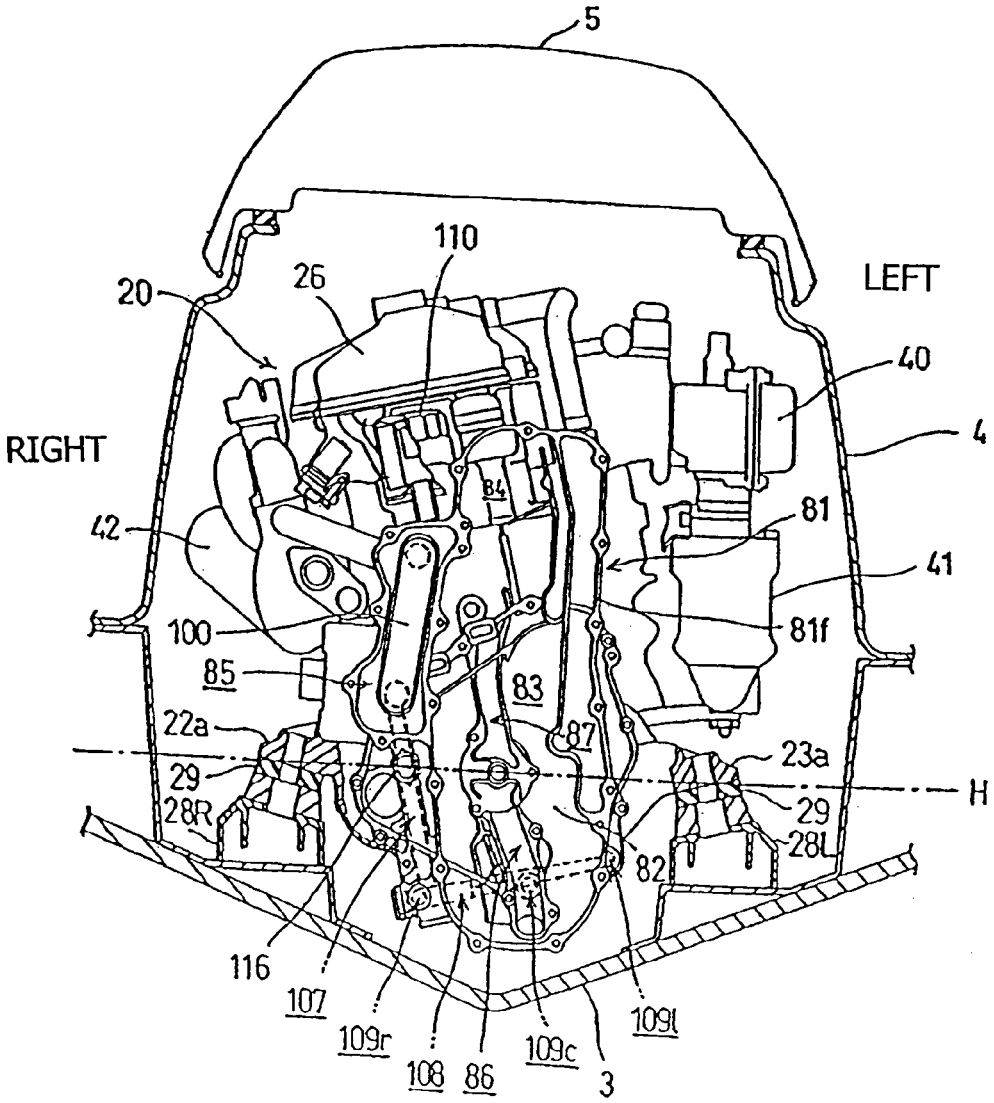
FIG. 4 is a front elevational and partially sectional view of the vessel body and the internal combustion engine of FIG. 1 showing the internal combustion engine inclined to a right side of the vessel body.

Accordingly, the mount bracket 22*a* and the mount bracket 23*a*, arranged respectively at the right and left sides of the internal combustion engine 20, protrude at an obtuse angle relative to each other. As shown in FIG. 4, each of the mount brackets 22*a*, 23*a* is fixed to mounts 28L, 28R formed on the interior surface of the hull 3. The mounts 28L, 28R are arranged at the same horizontal height and at the right and left sides of the hull 3 through anti-vibration rubber members 29, 29, so as to supportively receive the internal combustion engine 20 thereon.

Accordingly, the split plane 24 between the cylinder block 22 and the crankcase 23 is in parallel with the protruding direction of the left side mount bracket 23*a*. As a result, the split plane 24 has an angle increased leftward in respect to a horizontal line H and is generally inclined (refer to FIGS. 4 and 6).

The internal combustion engine 20 is formed such that a cylinder 22*b* of the cylinder block 22 extends in a direction perpendicular to the split plane 24, and a cylinder head 25 and a cylinder head cover 26 are arranged in direction of extension. At the same time, the oil pan 27 is also fixed to the underside of the crankcase 23 in a direction perpendicular to the split plane 24, so that the internal combustion engine 20 is entirely inclined toward the right side as shown in FIG. 4 (and FIG. 6) and mounted on the vessel body 2.

As shown in FIG. 6, a piston 30 reciprocates within the rightward-inclined cylinder 22*b*, whereby the crankshaft 21 is rotated through a connecting rod 31. The cylinder head 25 resides on an upper side of the cylinder 22*b*, and is made such that a combustion chamber 32 is formed in opposition against the top surface of the piston 30. The combustion chamber 32 has openings, and an intake port 33I and an exhaust port 33E extend from these openings in a lateral direction.

Camshafts 35I, 35E respectively actuate an intake valve 34I for opening or closing an opening of the intake port 33I, and an exhaust valve 34E for opening or closing an opening of the exhaust port 33E. The camshafts 35I, 35E are arranged at an aligning surface that is positioned between the cylinder head 25 and the cylinder head cover 26.

A surging tank 40, communicating with the intake port 33I and an intercooler 41, is connected to and arranged on the left side of the main body of the internal combustion engine 20. An exhaust manifold 42, communicating with the exhaust port 33E, is connected to and arranged on the right side of the engine 20 (refer to FIGS. 4 and 5).

Figure 5:
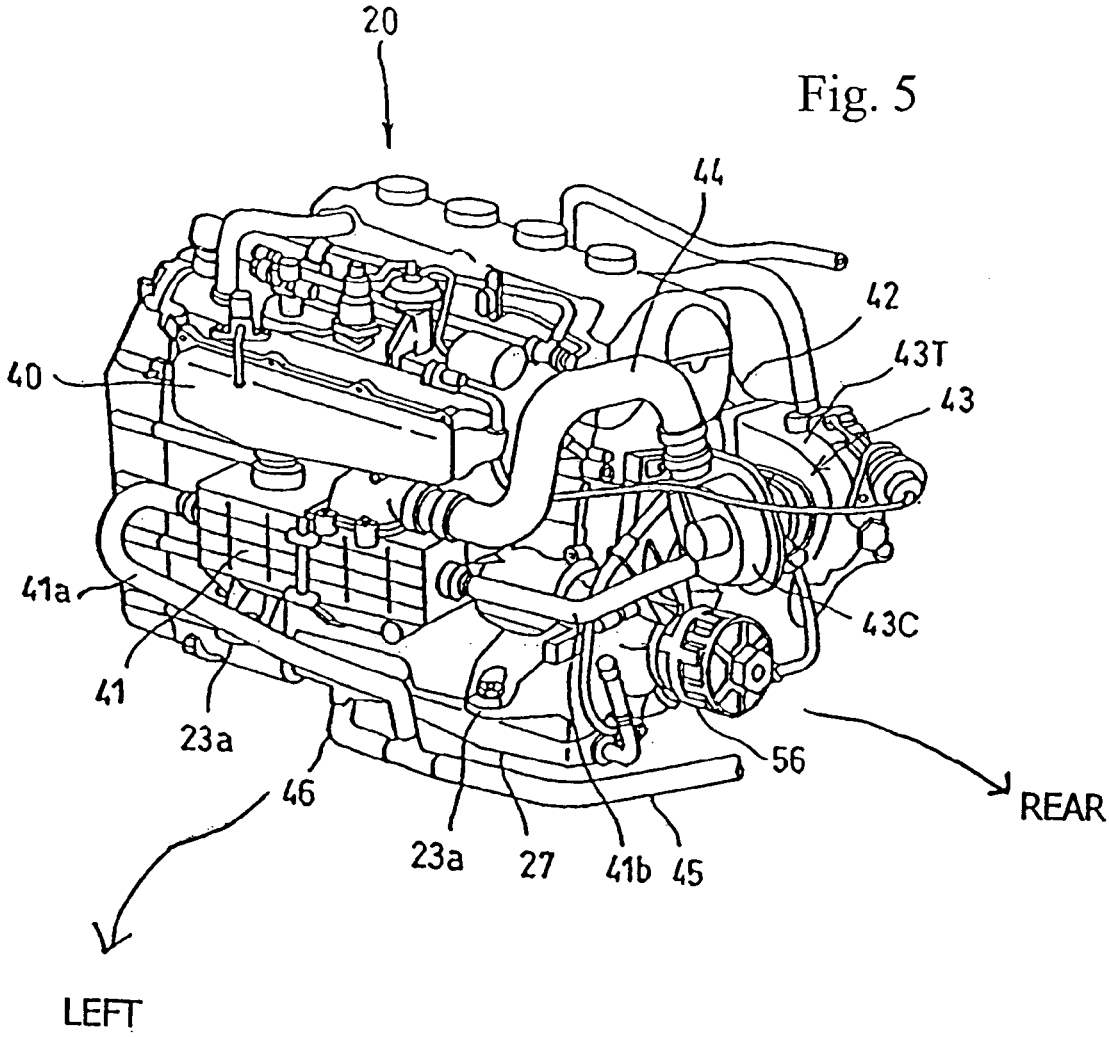
FIG. 5 is an isolated perspective view of the internal combustion engine of FIG. 1 showing a surge tank and intercooler mounted on a left side thereof, a turbocharger mounted on a right side thereof, and connecting pipes therebetween.

As shown in FIG. 5, a turbo-charger 43 is arranged at a rear part of the internal combustion engine 20. The turbo-charger 43 is constructed such that an exhaust outlet of the exhaust manifold 42 is connected to its turbine segment 43T, and further, a connecting pipe 44 from the intercooler 41 is connected to the compressor part 43C of the turbocharger 43.

A cooling water feeding hose 45 permits feeding of cooling water from a positive pressure side of the jet propulsion pump 10 and is branched downstream of the pump 10. A first branch thereof forms a cooling water hose 41*a*, which extends between the feeding hose 45 and the intercooler 41. A cooling water hose 41*b* extends from the other (downstream) side of the intercooler 41, and is connected to the turbo-charger 43 (refer to FIG. 17).

The cooling water hose 46, formed of the second branch of the cooling water feeding hose 45, extends toward an oil cooler 100 located at the front side of the internal combustion engine 20 to be described later (refer to FIG. 17). Further, as shown in FIGS. 1 and 2 and referring to FIG. 17, the exhaust gas, used to rotate the turbine wheel at the turbine segment 43T of the turbo-charger 43, passes in sequence through an exhaust pipe 47*a*, an anti-back flow chamber 47*b* (a chamber for preventing back-flow of water to prevent water from entering into the turbo-charger or the like at the time of turnover), a water muffler 47*c* and piping 47*d*, reaches the water chamber 47*e*, which is in communication with water, and then is discharged into the water.

As described above, although the crankshaft 21 is rotatably pivoted by means of bearings positioned at each end of the split plane 24 between the cylinder block 22 and the crankcase 23, two balancer shafts 36L, 36R, which eliminate secondary vibration, are rotatably pivoted at bearings at the right and left sides of the crankshaft 21.

A total number of five crank journals 21*j* are provided within the cylinder block 22. Specifically, a crank journal 21*j* is positioned between each of the respective four pairs of crank webs 21*w* corresponding to four cylinders of the crankshaft 21, providing three such crank journals 21*j*. In addition, the front and rear two crank journals 21*j* are provided corresponding to the front and rear faces of the cylinder block 22. The five crank journals are held and rotatably pivoted through metal bearings at semi-arcuate landings formed at five ribs 22*r*, 23*r* forming vertical walls in a forward or rearward direction. Ribs 22*r*, 23*r* are formed at each of both upper and lower sides of the cylinder block 22 and the crankcase 23 (refer to FIGS. 7 and 9). The central rib of the five ribs 22*r* will be referred to as central rib 22*rc*.

As shown in the bottom view of the cylinder block 22 in FIG. 9, the four non-central ribs 22*r*, of the five ribs 22*r* for supporting the crankshaft 21 at its bearings, extend generally within a plane between both right and left ends, without being curved. However, the left and right ends of the central rib 22*rc* are curved so as to be biased, or displaced, forward of the bearings (left side in FIG. 9) that pivotally support the crankshaft 21.

The right and left forward-displaced portions of the central rib 22*rc* are provided with rear side bearings for the balancer shafts 36L, 36R. The front side bearings for the balancer shafts 36L, 36R are arranged at the right and left portions of the rib 22*r* that forms the forward-most outer wall. That is, the balancer shafts 36L, 36R are arranged in parallel at the right and left portions of the crankshaft 21, and are rotatable at their front and rear portions through metal bearings, for example, at the bearing of the forward-most rib 22*r* and the bearing of the central rib 22*rc*. As a result, the balancer shafts 36L, 36R are longitudinally arranged so as to be offset toward the front side of the cylinder block 22.

The balancer shafts 36L, 36R are divided by the central rib 22*rc* such that balance weights 36Lw, 36Rw are positioned on the balancer shafts 36L, 36R between the central rib 22*rc* and its front adjoining rib 22*r*. In addition, there are provided balance weights 36Lw, 36Rw cantelivered at the rear end portion of the balancer shafts 36L, 36R, positioned rearward of the central rib 22*rc*.

As seen in horizontal section, the cylinder block 22 is formed having a lateral width in the front portion thereof, where balancer shafts 36L, 36R are arranged, that is large, and its lateral width in the rear portion thereof, where balancer shafts 36L, 36R are not arranged, is relatively narrow. Since the balancer shafts 36L, 36R have their rear portions supported at the bearings displaced forward of the central rib 22*rc*, the rear portions of the balancer shafts 36L, 36R are positioned as far forward as possible. Correspondingly, the proportion of the horizontal section that is of a narrow lateral width, that is, the rear side portion of the cylinder block 22, is kept large so that the overall size of the main body of the internal combustion engine 20 is compact.

In addition, since the rear part balance weights 36Lw, 36Rw are not supported at both ends, but instead are supported in a cantilever form, the entire length of the balancer shafts 36L, 36R is made short, and bearings are not required at the rear ends. Correspondingly, the narrow lateral width at the rear portion of the cylinder block 22 is assured to be large, further enhancing the effect of forming the overall a size of the main body of the internal combustion engine 20 in a compact manner.

Figure 7:
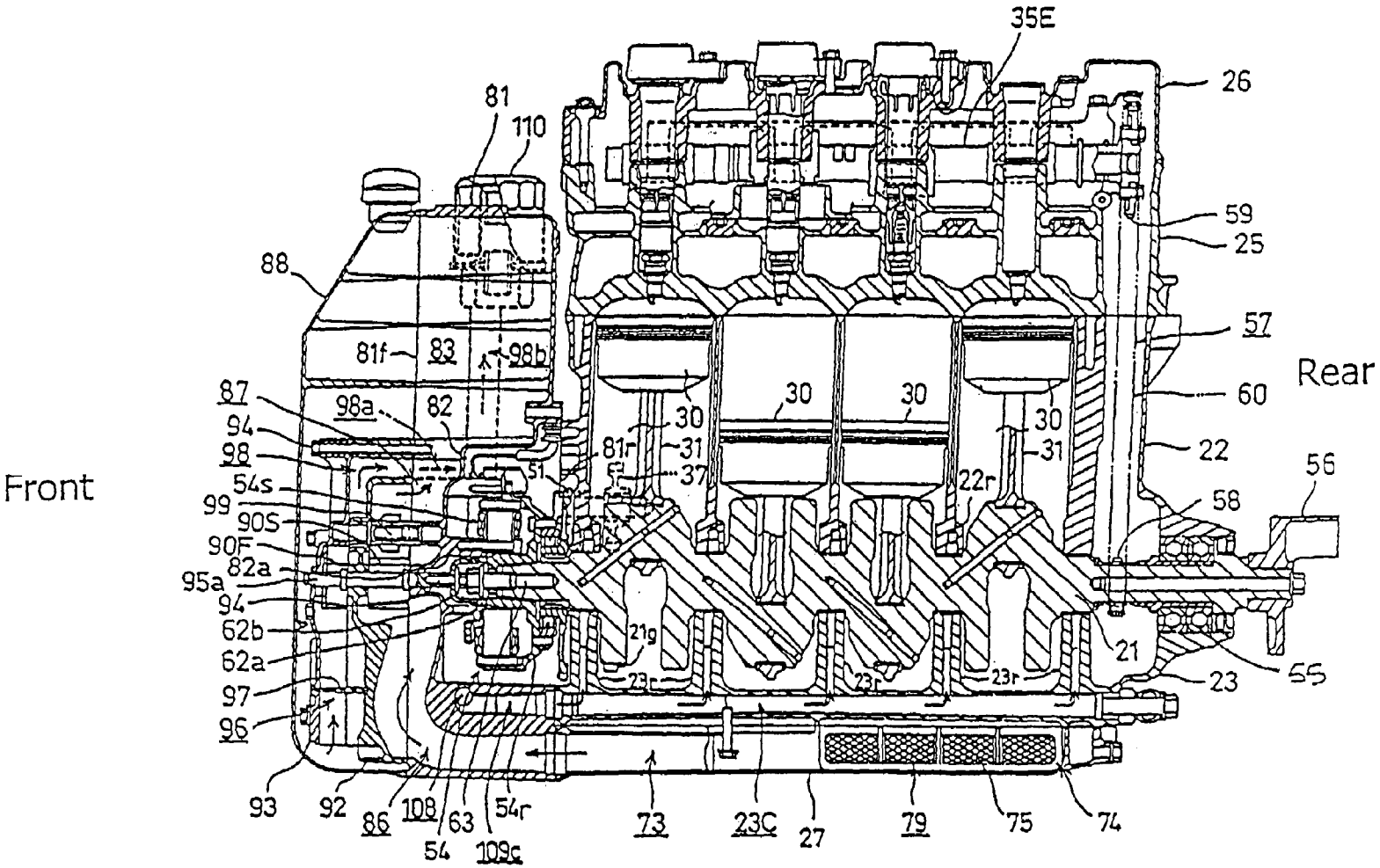
FIG. 7 is a side sectional view of the internal combustion engine of FIG. 1 showing a crankshaft supported on a plurality of ribs formed on an interior surface of the cylinder block, and showing an oil cooling system mounted on a front face of the engine.

Further, the crankcase 23, connected to the split plane 24 of the cylinder block 22, also has five ribs 23*r* corresponding to five ribs 22*r* of the cylinder block 22 (refer to FIG. 7). The central rib 23*rc* is displaced forward at its left and right ends. As a result, it is possible to assure a large narrow lateral width portion at the rear part of the main body of the internal combustion engine 20, and auxiliary machines are arranged within the acquired lateral vacant space at the rear side of the internal combustion engine 20, permitting the overall size of the internal combustion engine 20 to be made even more compact.

As shown in FIGS. 7 and 9, a drive gear 21*g* is formed at the outer circumference of the crank web 21*w* of the crankshaft 21 rotating along the inner surfaces of the ribs 22*r*, 23*r* which form the forward-most outer walls of the cylinder block 22 and the crankcase 23. In turn, the balancer shafts 36L, 36R are also formed with driven gears 36Lg, 36Rg along the inner surfaces of the ribs 22*r*, 23*r* which form the forward-most outer walls.

The driven gear 36Lg of the left balancer shaft 36L and the drive gear 21*g* at the outer circumference of a crank web 21*w* of the crankshaft 21 are directly engaged to each other. In turn, as shown in FIG. 6, an intermediate shaft 37 is supported at the rib 22*r* of the cylinder block 22 at a diagonally left upper part of the driven gear 36Rg of the right balancer shaft 36R. An intermediate gear 37*g* rotatably pivots on the intermediate shaft 37, and is engaged with the driven gear 36Rg of the right balancer shaft 36R, and further is also concurrently engaged with the drive gear 21*g* at the outer circumference of the crank web 21*w* of the crankshaft 21.

Accordingly, the right and left balancer shafts 36L, 36R are rotated in an opposite direction to each other through rotation of the crankshaft 21, and are rotated at twice rotating speed of the crankshaft 21 so as to eliminate its secondary vibration.

A gear mechanism comprised of the drive gear 21*g* for transmitting a rotation of the crankshaft 21 to the right and left balancer shafts 36L, 36R, intermediate gear 37*g*, driven gears 36Lg, 36Rg is arranged inside the cylinder block 22 and the crankcase 23 along the inner surfaces of the ribs 22*r*, 23*r* forming the forward-most outer walls and is placed at the position where it is overlapped at the same rearward positions as those of the mount brackets 22*a*, 23*a* of the cylinder block 22 and the crankcase 23 as seen from its side elevational view.

Accordingly, a rigidity around the gear mechanism for use in transmitting a rotating power force at the cylinder block 22 and the crankcase 23 and at the bearing portions of the balancer shafts 36L, 36R can be assured in a sufficient high value without adding any special structure.

Since the cylinder block 22 of the crankshaft 21 and the crank web 21*w* inside the crankcase 23 are provided with a drive gear 21*g*, the crankshaft 21 itself can be made shorter, and the entire length of the internal combustion engine 20 can be correspondingly shorter, as compared with those of the prior art structure where the drive gear is provided independently.

The portion of the crankshaft 21 that protrudes out of the ribs 22*r*, 23*r* which form the front outer walls of the cylinder block 22 and the crankcase 23 is provided with a driven gear 51 for a starter. The driven gear 51 is connected to the crankshaft 21 through a one-way clutch 50 as shown in FIG. 9, and is positioned along the outer surfaces of the ribs 22*r*, 23*r*. At the same time an outer rotor 54*r* of an AC generator 54 is fixed at a more forward location than the driven gear 51 for a starter (refer to FIG. 7).

The driven gear 51 for a starter itself can be made smaller than an arrangement in which the driven gear 51 for a starter, applied through the one-way clutch 50, is arranged side by side to the drive gear not integral with the crank web, as found in the prior art, but instead is arranged independently so as to avoid an interference from each other.

As indicated by a two-dot chain line in FIG. 6, a small diameter gear 52*a*, rotatably supported by a reduction gear shaft 52, is engaged with the driven gear 51 for a starter. A large diameter gear 52*b*, integral with the small diameter gear 52*a*, is engaged with the drive gear 53*a* fitted to a driving shaft of the starter motor 53, positioned above the left balancer shaft 36L.

In turn, the rear part of the crankshaft 21 is pivotally supported on the bearings 55 on the rear walls of the cylinder block 22 and the crankcase 23, and protrudes rearward, as shown in FIG. 7. The rear end of the crankshaft 21 is connected to the shaft 15 connected to the impeller 11 of the jet propulsion pump 10 through a coupler 56.

Referring to FIG. 7, this figure shows that a cam chain chamber 57 is formed between the rear-most ribs 22*r*, 23*r* and the rear walls of the cylinder block 22 and the crankcase 23. A drive sprocket 58 is fitted to the crankshaft 21 within the cam chain chamber 57, and a cam chain 60 encircles both the drive sprocket 58 and the driven sprockets 59, 59 which are fitted to the rear ends of the upper camshafts 35I, 35E.

As seen in a bottom view of the crankcase (FIG. 10), the lower surface of the crankcase 23 has a longitudinally elongate rectangular opening formed thereon. A circumferential edge of the opening is formed with an aligning surface 23*b* upon which an oil pan 27 is fixed from below, in compliance with this aligning surface 23*b*.

Figure 11:
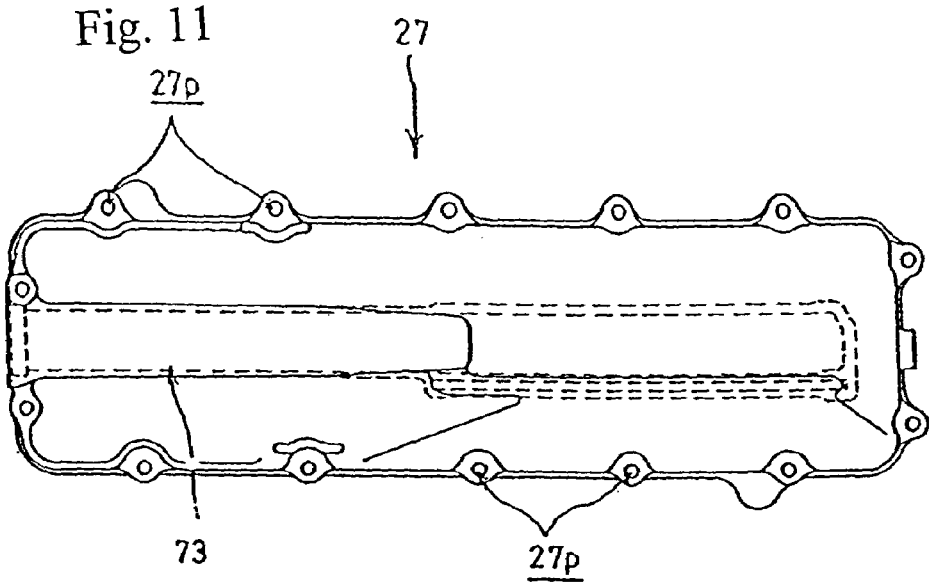
FIG. 11 is a bottom view of an oil pan of the internal combustion engine of FIG. 1 showing an oil recovery path opening to one end, and showing fixing holes at spaced intervals about the periphery of the oil pan.
Figure 12:
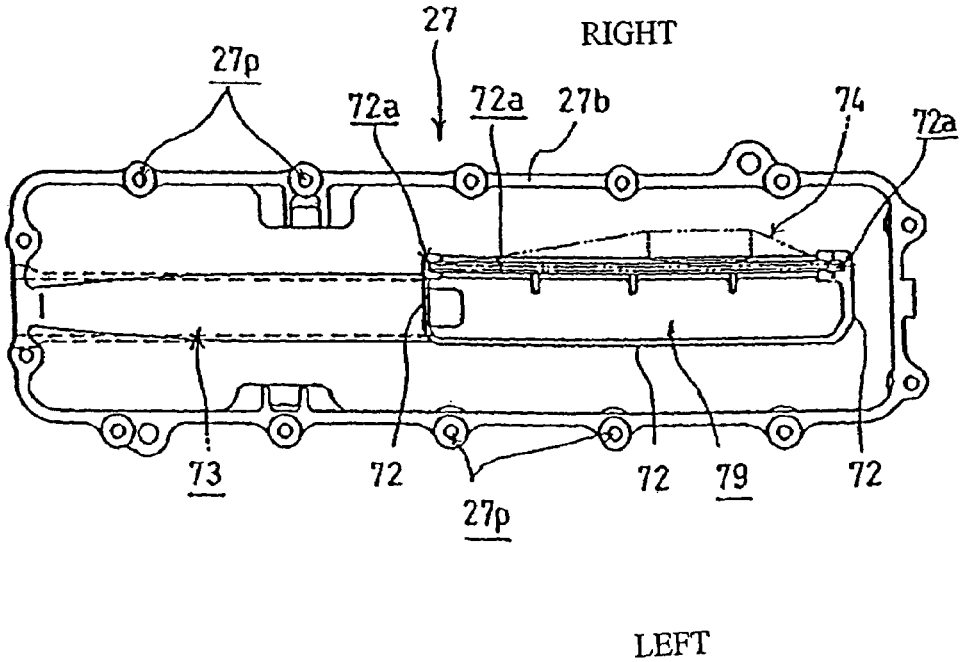
FIG. 12 is a top plan view of the oil pan of FIG. 11 showing a cavity formed on three sides by a three-sided wall structure and on a fourth side by an oil strainer, and showing the oil recovery path opening into the cavity.

The rectangular aligning surface 23*b* is formed with a plurality of threaded holes 23*p* provided at spaced intervals about the aligning surface 23*b*. As shown in FIGS. 11 and 12, a bolt 61 is passed through each of a corresponding fixing hole 27*p* formed at a rectangular circumferential edge aligning surface 27*b* of the oil pan 27, and threadably inserted into a threaded hole 23*p* whereby the oil pan 27 is fixed to the crankcase 23.

Figure 10:
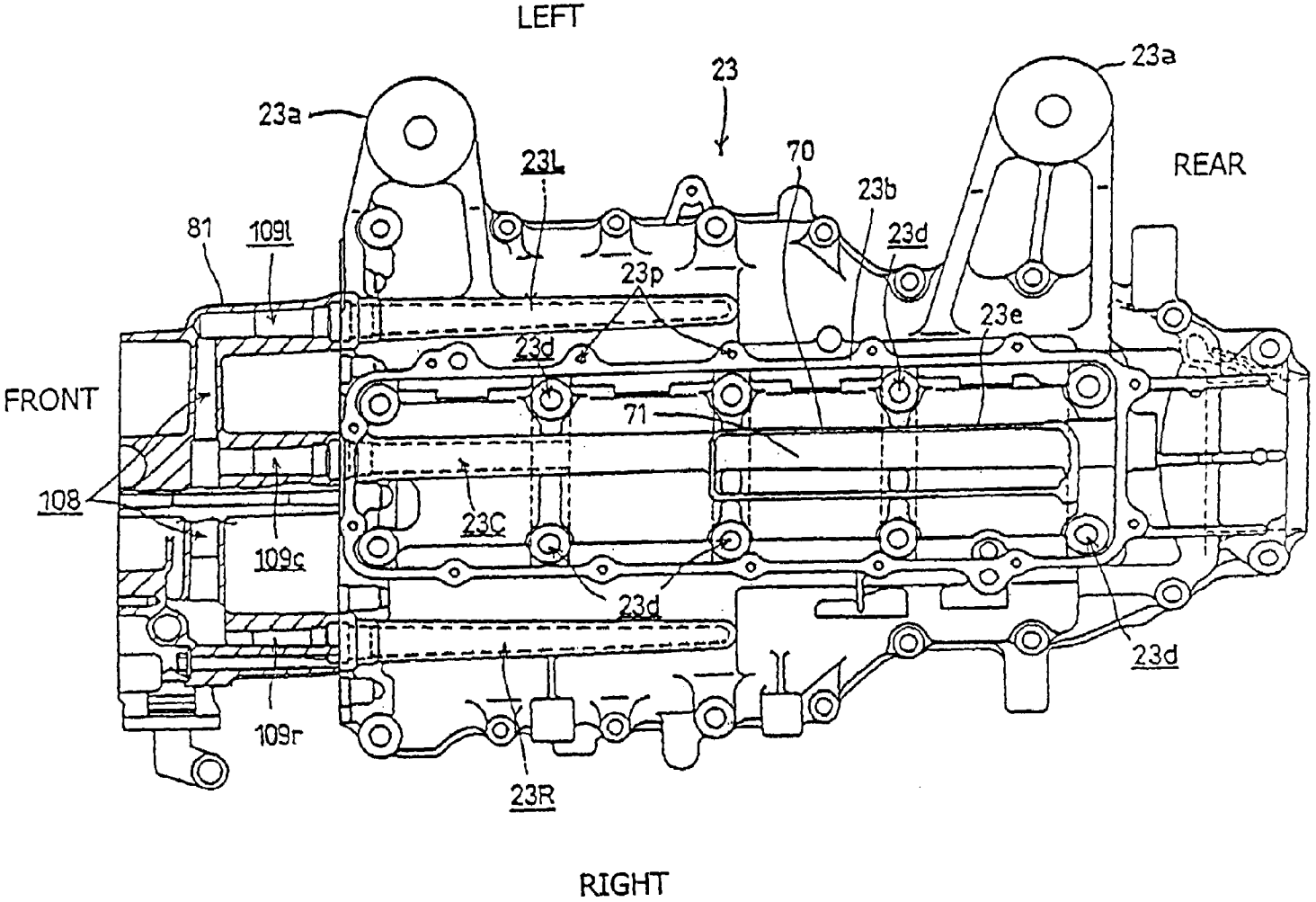
FIG. 10 is a bottom view of a crankcase of the internal combustion engine of FIG. 1 showing a longitudinally elongate rectangular opening formed in the bottom surface of the crankcase, and showing the aligning surface comprised of a circumferential edge of the opening, upon which the oil pan is fixed from below.

Referring to FIG. 10, a main oil passage 23C extends longitudinally along the lower surface of the crankcase 23, and opens at the front wall of the crankcase 23. Bolt holes 23*d* are formed on the right and left sides of each rib 23*r* so as to be laterally opposed across oil passages 23C. A fastening bolt 38 is passed through each bolt hole 23*d*, and is threadably inserted into the cylinder block 22 to fasten the crankcase 23 to the cylinder block 22, whereby they are coupled together (refer to FIG. 6).

Further, oil passages 23L, 23R for the right and left balancers, used to supply oil to the bearings of the right and left balance shafts 36L, 36R, are arranged along the right and left sides of the main oil passage 23C so as to be in parallel with the main oil passage 23C. The oil passages 23L, 23R for the right and left balancers are open at the front wall of the crankcase 23 (refer to FIG. 6).

In addition, within the periphery of the rectangular aligning surface 23*b* of the crankcase 23, and at its rear half part, an elongate, longitudinally extending, parallelepipedic frame wall 70 is formed having four sides. An inside part of the frame wall 70 has an upper surface 71 (corresponding to the bottom of the crankcase), and the lower side is open (refer to FIG. 10). The lower end surface of the frame wall 70 is set at the same height as, that is, lies flush with, that of the aligning surface 23*b* with the oil pan 27.

In turn, as shown in FIGS. 11 and 12, the oil pan 27 is provided with a frame wall 27 on an upper surface thereof. The frame wall 72 is composed of three side walls, i.e. a front wall, a rear wall and a left wall, and a fourth (right) wall thereof is absent. The right side wall of the frame wall 70 of the crankcase 23 is vertically installed downward from the bottom surface of the crankcase to a location within the oil pan 27. An oil recovering passage 73, having a circular opening and extending straight forward from the front wall of the frame wall 72, is opened at the front wall of the oil pan 27 (refer to FIG. 6) and communicates with an oil pump 90 to be described later.

As shown in FIG. 12, inner edges of three sides of the frame wall 72 which bound the absent right wall, that is, the front wall, rear wall and bottom wall, are formed with grooves 72*a*. A long rectangular oil strainer 74 is fitted within the grooves 72*a* in a substantially vertical posture.

Figure 13:
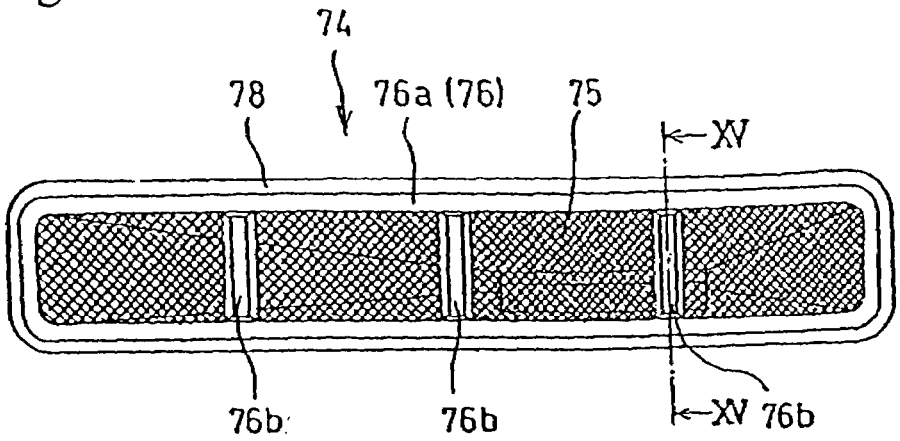
FIG. 13 is a side elevational view of the oil strainer of FIG. 12, showing a screen supported by a frame, and showing protrusion of the cover part of the oil strainer offset toward a lower side of the oil strainer.
Figure 14:
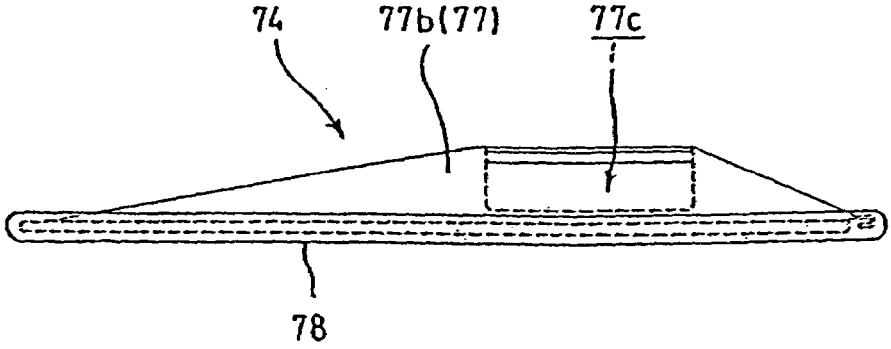
FIG. 14 is a top plan view of the oil strainer of FIG. 12, showing the pyramidal protrusion of the cover part, and showing an opening formed in a lower face of the protrusion.
Figure 15:
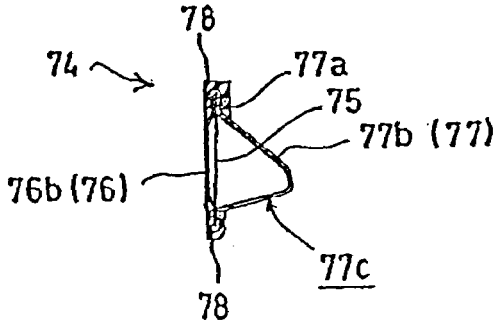
FIG. 15 is a sectional view of the oil strainer taken along line XV—XV in FIG. 13, showing the opening formed in a lower face of the cover part.

As shown in FIGS. 13 to 15, the oil strainer 74 is made such that the circumferential edge of a band-like long oil screen 75 is held at its right and left portions by a stopper frame 76 and a screen cover 77, and the holding part is enclosed by a rubber member 78.

The stopper frame 76 includes a flat rectangular frame, closed in shape, and cross members 76*b*. In particular, the stopper frame 76 has a shape in which three cross-member 76*b* extend between the long opposed sides of the flat rectangular frame 76*a* to form large four openings. The screen cover 77 comprises a frame part 77*a* surrounding a cover 77*b*. The cover 77*b* protrudes outward in pyramid-shape, the apex of the pyramid being displaced to one side, adjacent to a frame part 77*a*. Frame part 77*a* corresponds to the frame 76*a* of the stopper frame 76, and a rectangular shape is cut out of lower portion of the cover 77*b* to form an opening 77*c*.

The frame 77*a* of the screen cover 77 holds the circumferential edge of the oil screen 75 between itself and the frame 76*a* of the stopper frame 76, goes around the back part of the frame 76*a*, and fastens it to apply tension to the oil screen 75.

The aforesaid oil strainer 74 is fitted by means of the rubber member 78 to the grooves 72*a* of three sides adjacent the absent right wall of the frame wall 72 in the oil pan 27. When in place, the cover part 77*b* of the screen cover 77 protrudes to the right side (refer to FIG. 12 and the oil strainer 74 is indicated by a two-dot chain line), and the opening 77*c* opens downward.

When the oil pan 27 is fixed to the crankcase 23 while the oil strainer 74 is fitted to the groove 72*a*, the frame wall 70 of the crankcase 23 and the frame wall 72 of the oil pan 27 are abutted to each other at their end surfaces, the upper end rubber member 78 of the oil strainer 74 is abutted against the right wall of the frame wall 70, a space in the oil pan 27 is partitioned by the frame walls 70, 72, upper surface 71, oil pan bottom surface and oil screen 75 to form a rectangular parallelepiped cavity 79. The cavity 79 communicates with the oil recovering passage 73 through an opening at the front wall of the frame wall 72.

As described above, since the internal combustion engine 20 is mounted on the vessel body 2 so as to be inclined rightward as a whole, the rectangular parallelepiped cavity 79 defined in the oil pan 27 is set such that the oil screen 75 of the oil strainer 74 occupies the right opening, which is placed at a lower position of the cavity 79. That is, oil accumulated in the oil pan 27 is gathered eccentrically at the right side to enable the oil strainer 74, defining the right opening of the cavity 76, to be constantly submerged in the oil.

Oil accumulated in the oil pan 27 is drawn in an opening 77*c* of the screen cover 77 of the oil strainer 74, passes through the oil screen 75 and flows into the cavity 79. At this time, a minimal amount of air is drawn in because the oil strainer 74 is constantly submerged in the oil.

Since the oil strainer 74 occupies the cavity 79 in a substantially vertical orientation, the lateral width of the oil pan 27 can be reduced than compared to case in which the oil pan is installed horizontally as shown in the prior art. Thus, it becomes easy to align the oil strainer 74 to fit with the right or left inclination from the center of the bottom of the personal watercraft 1, and the internal combustion engine 20 can be mounted at a slightly lower position.

In addition, although it is necessary to have a space including a certain degree of margin in its vertical orientation when the oil pan is installed using the prior art horizontal orientation, installation under a substantial vertical orientation, as in the case of the present oil strainer 74, enables a sufficient space to be assured at the lateral sides of the oil strainer 74 even if the vertical width of the oil pan is small, enables a vertical width of the oil pan 27 itself to be reduced, enables an entire height of the internal combustion engine 20 to be shortened, and further facilitates mounting the engine onto the boat bottom part of the personal watercraft 1 even more.

Since the cavity 79, defined by the oil strainer 74, is constituted by the frame wall 70 formed at the crankcase 23, the upper surface 71, the frame wall 72 formed at the oil pan 27 and the oil pan bottom surface, no special or exclusive parts are required, and the number of component parts can be reduced. Additionally, the oil strainer 74 is also constructed to be held between the crankcase 23 and the oil pan 27 providing superior assembly characteristics.

Front surfaces of the aforesaid cylinder block 22, crankcase 23 and oil pan 27 are formed with aligning surfaces 22*f*, 23*f* and 27*f* forming a common plane (refer to FIG. 6). A tank main body 81 of the oil tank 80 is connected to the aligning surfaces 22*f*, 23*f* and 27*f*. Further, the oil tank 80 is constituted of the tank main body 81 and the tank cover 88, which covers the front surface of the tank main body 81.

As shown in FIGS. 4 and 7, the tank main body 81 has an aligning surface 81*r* connected to the aligning surfaces 22*f*, 23*f* and 27*f* formed at the front surfaces of the cylinder block 22, crankcase 23 and the oil pan 27. The tank main body 81 also has an aligning surface 81*f* for connection with the tank cover 88, the aligning surfaces 81*r*, 81*f* being in parallel with each other. An ACG cover part 82, protruding forward from the aligning surface 81*r* to cover the AC generator 54 or reduction gears 52*a*, 52*b*, is provided. An entire longitudinal oil storing part 83 is formed over above and right and left sides of the ACG cover 82, and a water-cooled type oil cooler housing 85 is formed to protrude above the crankshaft 21 at the right side of the oil storing part 83.

Further, FIG. 4 is a front view that shows the tank main body 81 fixed to the front surfaces of the cylinder block 22, crankcase 23 and oil pan 27. The upper space of the oil storing part 83 is provided with a breather chamber 84.

As shown in FIG. 7, an outer rotor 54*r* of the AC generator 54 is fixed to the extremity end of the crankshaft 21 together with the coupling 62*a* by a bolt 63. The coupling 62*a* is connected to a coupling 62*b* at the rear end of a pump shaft 95 of the oil pump 90 to be described later.

A coupling cover part 82*a* covering the couplings 62*a*, 62*b* protrudes rearward at the central part of the ACG cover 82. An inner stator 54*s* of the AC generator 54 is supported by being fixed to the coupling cover part 82*a*.

An oil pump 90 is provided at a front part of the ACG cover part 82 covering the AC generator 54 from the front side. The oil pump 90 includes a first case 92 connected to a front part to the tank main body 81, and a second case 93 connected to a front part, and fixed to, the tank main body 81 by a bolt 94 together with the first case 92. The pump shaft 95, coaxial with the crankshaft 21, passes through both of the front and rear first and second cases 92, 93, and together with the crankshaft 21 passes through the ACG cover part 82. The coupling 62*b* is fixed at its rear end by a bolt 95*a* from a rear side.

An inner rotor is fitted to a shaft part in the first case 92 of the pump shaft 95. A scavenging pump 90S is provided. An inner rotor is fitted to a shaft part in the second case 93, and a feed pump 90F is provided. Accordingly, rotation of the crankshaft 21 is transmitted to a rotation of the pump shaft 95 through couplings 62*a*, 62*b* so as to drive the scavenging pump 90S and the feed pump 90F.

Referring to FIGS. 4 and 7, an oil recovering passage 86 that communicates with the oil recovering passage 73 of the oil pan 27 is formed at the lower part of the tank main body 81. The oil recovering passage 86 is partially formed at the rear surface of the first case 92, extends upward and reaches to the scavenging pump 90S.

Accordingly, lubricant oil accumulated at the oil pan 27 passes through the oil strainer 74 under driving operation of the scavenging pump 90S and is drawn in at the front part of the oil recovering passage 73, passes through the oil recovering passage 86 and reaches to the upper scavenging pump 90S.

Referring to FIG. 7, a common recovering oil discharging passage 87 is formed above the scavenging pump 90S near the rear surface of the first case 92 and the front surface of the tank main body 81. The upper end of the recovering oil discharging passage 87 opens to the oil storing part 83 of the oil tank 80. Accordingly, the recovering oil discharged under a driving of the scavenging pump 90S passes through the recovering oil discharging passage 87 and is recovered at the oil storing part 83 of the oil tank 80.

In addition, as shown in FIG. 7, the supplying oil suction passage 96 is formed below the feed pump 90F between the front surface of the first case 92 and the rear surface of the second case 93, and at the same time, the supplying oil discharging passage 98 is formed above the feed pump 90F. The lower end of the supplying oil suction passage 96 opens at a height near the bottom surface of the oil storing part 83, and its upper end communicates with the suction port of the feed pump 90F. A screen oil filter 97 is installed at the midway part of the supplying oil suction passage 96.

The supply oil discharging passage 98 extends upward from the discharging port of the feed pump 90F. Thereafter, it is bent rearward and is connected to a lateral hole 98*a* formed at the tank main body 81. The lateral hole 98*a* communicates with a vertical hole 98*b* formed at the same tank main body 81, the upper end of the vertical hole 98*b* opens in an annular shape at the fixing surface of the oil filter 110, to be described later, and communicates with an oil inlet 111 of the oil filter 110 (refer to FIG. 8).

Accordingly, when the feed pump 90F is driven, the lubricant oil is drawn up through the supply oil suction passage 96 from the lower part of the oil storing part 83 of the oil tank 80, discharged to the supply oil discharging passage 98, forcedly fed upward at the lateral hole 98*a* and the vertical hole 98*b* formed at the tank main body 81, and then reaches the oil filter 110.

Further, a relief valve 99 is installed at the midway part of the supply oil discharging passage 98 between it and the oil storing part 83, and when a discharging pressure of the supply oil is too high, surplus oil is returned back to the oil storing part 83.

Figure 8:
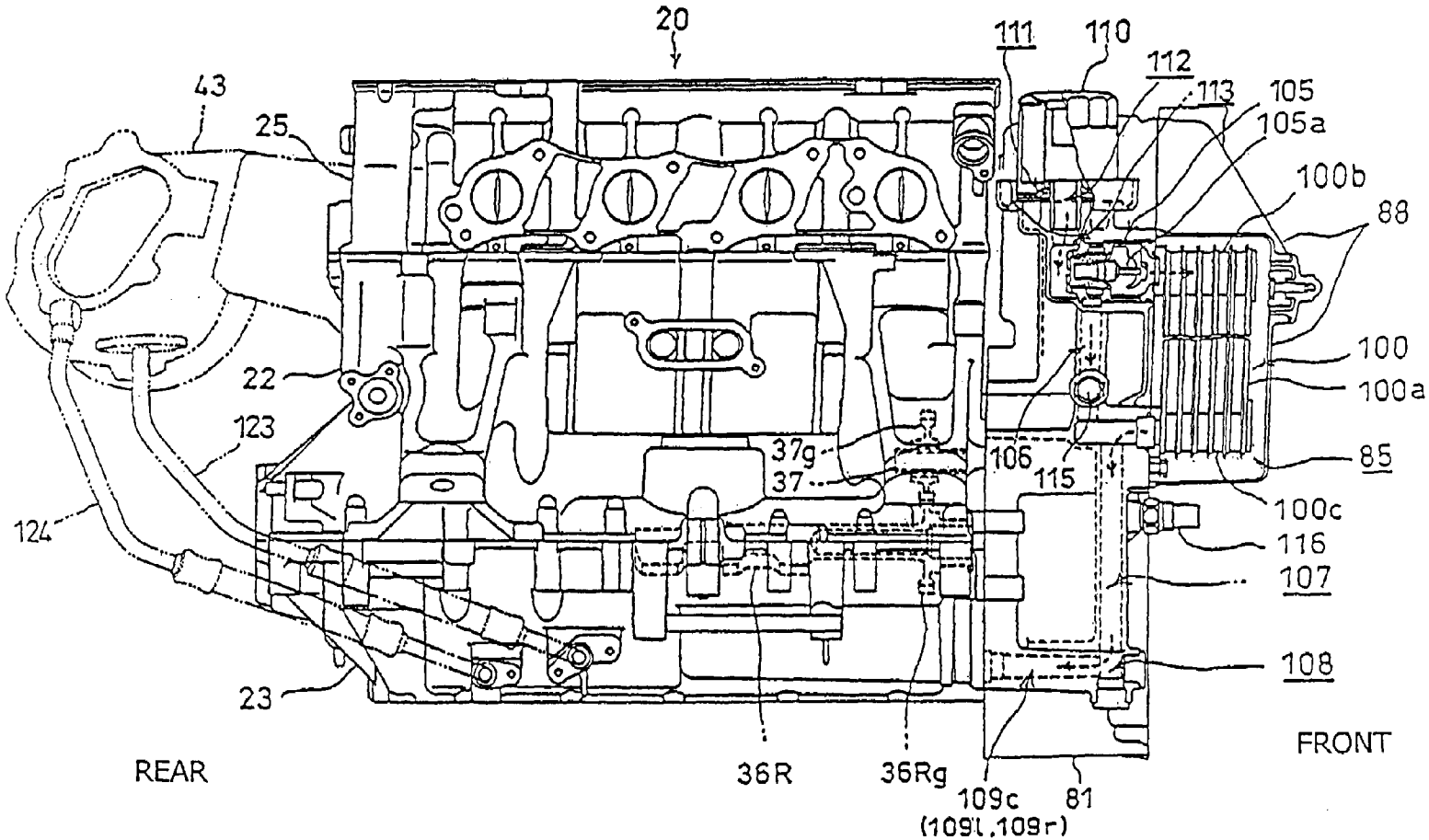
FIG. 8 is a right side elevational view of the internal combustion engine of FIG. 1 with a part being cut-away showing an oil cooler mounted within the oil a thermostat positioned upstream of an oil cooler, and an oil cooler bypass path bypassing the oil cooler which permits the thermostat to redirect oil around the oil cooler under certain conditions.

As shown in FIGS. 4 and 8, the water-cooling type oil cooler 100 is provided within the oil cooler housing 85, and protrudes longitudinally from the front surface of the tank main body 81. The oil cooler 100 is longer than it is wide, and comprises a plurality of heat exchanging plates 100*a* through which oil flows. An upstream side pipe 100*b* communicates with the upper part in the plates 100*a*, and a downstream side pipe 100*c* communicates with the lower part in the plates 100*a*, and each of the upstream side pipe 100*b* and the downstream side pipe 100*c* is connected to a respective upper hole and lower hole formed at the tank main body 81. The oil cooler 100 is fixed to the tank main body 81.

The oil cooler 100 is covered on its front side with a part of the tank cover 88 as shown in FIG. 8, so as to cause cooling water to flow in or flow out of the oil cooler housing 85, and within it, whereby the oil in the oil cooler 100 is cooled.

As shown in FIG. 8, the upper hole in the tank main body 81, to which the upstream side pipe 100*b* of the oil cooler 100 is connected, communicates with one outlet of an oil thermostat 105 provided with a changing-over valve 105*a* at the rear part of the upstream side pipe 100*b*. The lower hole, to which the downstream side pipe 100*c* of the oil cooler 100 is connected, communicates with an oil vertical passage 107 extending downward of the downstream side oil passage of the oil cooler 100. Another outlet of the oil thermostat 105 bypasses the oil cooler 100, and communicates with a bypass oil passage 106, which is connected to the oil vertical passage 107.

In addition, as shown in FIG. 8, the inlet of the oil thermostat 105 communicates with the oil outlet 112 of the oil filter 110. The oil outlet 112 is fixed to the upper part of the oil thermostat 105 by means of the upstream side oil passage 113 of the oil cooler 100. The oil filter 110 is operated such that the oil, forcedly fed by the feed pump 90F as described above, flows into the oil inlet 111, and the filtered oil flows out of the oil outlet 112.

When the lubricant oil is equal to or more than a predetermined temperature, the oil thermostat 105 opens the side of the oil cooler 100, and closes the bypass oil path 106, respectively, by means of the motion of the changing-over valve 105*a*. Moreover, when the lubricant oil temperature is lower than the predetermined temperature, the oil thermostat 105 opens the bypass oil passage 106, and closes the side of the oil cooler 100.

A low pressure oil switch 115 is fixed to the bypass oil passage 106 so as to detect an abnormal reduction of hydraulic pressure, and a high pressure oil switch 116 is fixed to the oil vertical passage 107 downstream side of both the oil cooler 100 and the bypass oil passage 106, so as to detect an abnormal increasing of hydraulic pressure.

As shown in FIG. 8, the low pressure oil switch 115 is fixed to the bypass oil passage 106 so as to protrude in a rightward direction, and in turn, the high pressure oil switch 116 is fixed to the oil vertical passage 107 so as to protrude in a forward direction, using the space below the oil cooler 100.

As indicated by a dotted line in FIG. 4, the oil vertical passage 107 is bent at the lower part of the tank main body 81 in a leftward direction and communicates with the oil lateral passage 108. The oil lateral passage 108 has three branched passages directed rearward. The central part of the oil lateral passage 108 is provided with a main gallery supplying passage 109*c* that supplies oil to the main gallery 23C of the internal combustion engine 20. The respective left and right ends of the oil lateral passage 108 are provided with a left balancer supplying passage 109*l* and a right balancer supplying passage 109*r* for supplying oil to the bearings for each of the right and left balancer shafts 36L, 36R (refer to FIG. 10).

Figure 16:
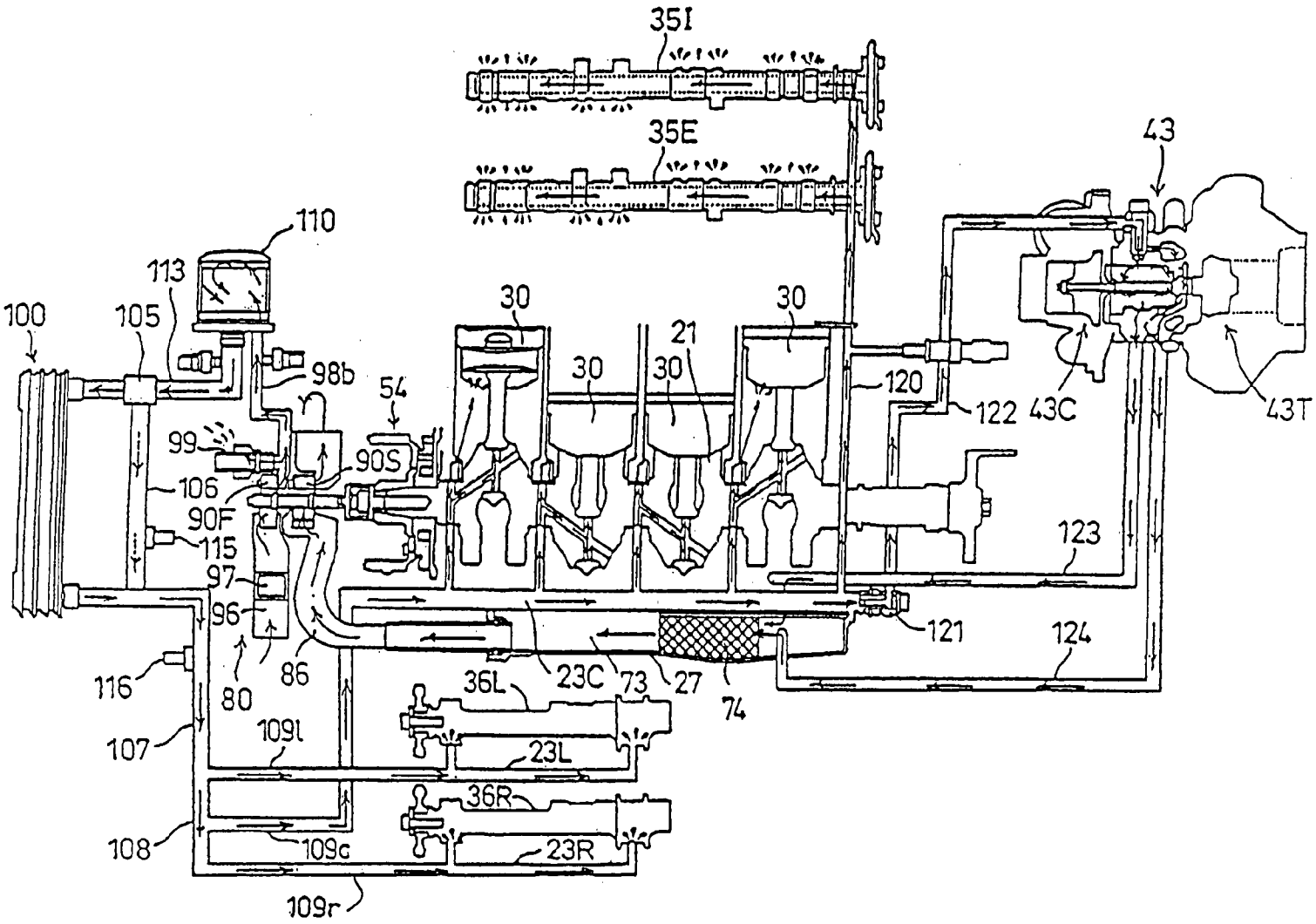
FIG. 16 is a diagram showing a circulation path of lubricant oil within the internal combustion engine of FIG. 1.

As shown in FIGS. 7 and 16, the main gallery supplying passage 109*c* is connected to the main oil passage 23C of the crankcase 23 and oil is distributed from the main oil passage 23C to each of the bearings of the crankshaft 21 and supplied to the passage in the rib 23*r*.

The left balancer supplying passage 109*l* and the right balancer supplying passage 109*r* are connected to each of the left balancer oil passage 23L and the right balancer oil passage 23R, respectively (refer to FIG. 10), whereby oil is supplied to the bearings of the right and left balancer shafts 36L, 36R.

Further, oil is supplied from the main oil passage 23C to the bearings of the upper camshafts 35I, 35E and at the same time oil is also supplied to the turbo-charger 43 so as to form circulation paths each returning to the oil pan 27.

In FIG. 16 is illustrated a circulation path diagram for lubricant oil described above and its entire flow will be described. Lubricant oil accumulated at the oil pan 27 is drawn by means of a driving operation of the scavenging pump 90S, filtered through the oil strainer 74, passes through the oil recovering passages 73, 86 and is drawn into the scavenging pump 90S. Lubricant oil discharged out of the scavenging pump 90S is recovered into the oil tank 80.

Lubricant oil recovered into the oil tank 80 is drawn by means of a driving operation of the feed pump 90F, passes through the screen oil filter 97, and is drawn into the feed pump 90F. Lubricant oil discharged out of the feed pump 90F passes through the lateral hole 98*a* and the vertical hole 98*b*, passes through the midway part relief valve 99, flows into the oil filter 110 where it is filtered, and then reaches the oil thermostat 105.

When the lubricant oil is at a temperature equal to or more than the predetermined temperature, the changing-over valve 105*a* opens a pathway to the oil cooler 100, permitting the lubricant oil to flow to the oil cooler 100 and to be cooled, while closing a bypass oil path 106. Cooled lubricant is discharged to oil vertical passage 107. When the lubricant oil reaches the thermostat 105 at a temperature below the predetermined temperature, the changing-over valve 105*a* closes the pathway to the oil cooler, and opens the bypass oil passage 106 permitting the lubricant oil to flow through the bypass oil passage 106, avoiding the cooling action of the oil cooler 100, and flowing to the downstream oil vertical passage 107. In addition, a low pressure oil switch 115 is fixed to the bypass oil passage 106, and the high pressure oil switch 116 is fixed to the oil vertical passage 107.

Lubricant oil that has flowed down the oil vertical passage 107 is branched at the lower end thereof within oil lateral passage 108 into three branch passages, whereby lubricant oil flows at the lower part of the crankcase 23 in a rearward direction. Lubricant oil branched at the right and left balancer supplying passages 109*l*, 109*r* passes through each of the right and left balancer oil passages 23L, 23R and is supplied to the bearings of the right and left balancer shafts 36L, 36R.

Lubricant oil branched at the central main gallery supplying passage 109*c* is further branched while passing through the main oil passage 23C and is supplied to each of the bearings of the crankshaft 21. Further, lubricant oil supplied to each of the bearings of the crankshaft 21 passes through the oil passage formed in the crankshaft 21 and is supplied to a connecting part with a large end of the connecting rod 31.

In addition, a camshaft oil supplying passage 120 is formed to extend from the main oil passage 23C in an upward direction. Lubricant oil that has ascended the camshaft oil supplying passage 120 flows in each of the in-shaft oil passages of the right and left camshafts 35I, 35E, and supplies the in-shaft oil passages to each of the bearings and each of the cam surfaces. Lubricant oil that has lubricated the crankshaft 21, right and left balancer shafts 36L, 36R and right and left camshafts 35I, 35E and the like finally returns back to the oil pan 27.

Further, the turbocharger oil supplying pipe 122 extends from the main oil passage 23C to the turbo-charger 43 through the oil filter 121. A part of the lubricant oil that has flowed through the main oil passage 23C passes through the turbocharger oil supplying pipe 121 and is supplies the turbocharger 43.

Lubricant oil supplied to the turbocharger 43 is branched to provide a first branch for lubricating the bearings and a second branch for shutting off heat at the turbine and cooling it. The lubricating oil within the two branches is returned back to the oil pan 27 through the two oil discharging pipes 123, 124.

Meanwhile, a cooling system for the internal combustion engine 20 of the present invention mounted on the personal watercraft 1 uses water on which the personal watercraft 1 floats. FIG. 17 illustrates the circulation path for the cooling water which is described as follows. As presented above, cooling water is fed from the cooling water intake port 131 at the downstream positive pressure side of the impeller 11 of the jet propulsion pump 10 by means of the cooling water feeding hose 45. Cooling water passing through one branched cooling water hose 46 of the cooling water feeding hose 45 is supplied to the oil cooler housing 85 of the oil cooler 100 placed at an upstream side of the jet propulsion pump 10. Cooling water is directed in from the downstream side cooling water in-flow part 85*a* to cool the lubricant oil, thereafter, the cooling water flows out of the upper cooling water out-flow part 85*b*, circulates at the water jacket of the cylinder block 22 of the internal combustion engine 20 to cool the internal combustion engine 20, and is discharged out of the boat.

Cooling water passing through the other cooling water hose 41*a* branched from the cooling water feeding hose 45 flows into the intercooler 41 to cool intake gas, and then flows to the turbo-charger 25 to cool the turbo-charger 25. Thereafter, the cooling water reaches the exhaust pipe 47*a* to cool the exhaust pipe 47*a* and at the same time the exhaust gas is taken into the cooling water, then the cooling water passes through the anti-backflow chamber 47*b*, water muffler 47*c* and pipe 47*d* in sequence and reaches the water chamber 47*e* communicating with the water, and then the cooling water is discharged into the water.

The oil thermostat 105 in the aforesaid lubricating system opens the oil path through the oil cooler 100 when the lubricant oil shows a temperature equal to or more than the predetermined temperature, so as to cool the lubricant oil, thereby cooling of the internal combustion engine 20 can be promoted.

In turn, when the lubricant oil shows a temperature lower than the predetermined temperature, the bypass oil passage 106 is opened directing the lubricant oil bypass the oil cooler 100 and not to be cooled. In this manner, idling operation is promoted and over-cooling at the time of a cooling operation is prevented in advance.

The personal watercraft 1 is operated such that cooling water fed from the positive pressure side of the jet propulsion pump 10 is used for cooling the internal combustion engine 20, and the oil cooler 100 also utilizes this cooling water, so that it is easy for over-cooling to occur during a cooling operation, and passing the lubricant oil through the oil cooler causes it to reach an over-cooled state more easily. To avoid this situation, the lubricant oil is not passed through the oil cooler 100 under a control of the oil thermostat 105 at a temperature lower than the predetermined temperature, where the over-cooling is apt to occur, but instead bypasses the oil cooler 100 to avoid the over-cooling at the time of cooling operation.

Since over-cooling is avoided, even if fuel in the combustion chamber 32 enters into the crankcase 23 and is mixed with oil, evaporation of oil is promoted since the oil temperature is increased, and dilution is prevented, whereby oil deterioration is restricted.

Since both the bypass oil passage 106 and the discharge from the oil cooler communicate with the downstream side of the bypass oil passage 106, the bypass oil passage 106 is always filled with lubricant oil. The bypass oil passage 106 is provided with the low pressure oil switch 115, whereby an abnormal reduction in hydraulic pressure is stably detected.

The oil vertical passage 107 at the downstream side of the oil cooler 100 is provided with the high pressure oil switch 116 to enable detection of an abnormal increasing of hydraulic pressure caused by clogging at the oil passage to be lubricated such as each of the downstream side bearings or the like. When the abnormal state of hydraulic pressure is detected by one or both of the low pressure oil switch 115 and the high pressure oil switch 116, countermeasures, including producing an alarm for bringing the condition to an operator's attention, are carried out.

The oil cooler 100 is made such that a size of the heat exchanging plates 100*a* is short and small as compared with that of the prior art. Moreover, the lower part of the oil cooler 100 is displaced upward and located at a higher position than the crankshaft 21, and the oil cooler housing 85 itself is also located at a higher position than the crankshaft 21 at its lower part. Accordingly, as shown in FIG. 8, a space is formed below the oil cooler 100, which protrudes from the tank main body 81. Thus, some auxiliary units can be arranged below the oil cooler 100 to utilize the space, and the high pressure oil switch 116 is arranged to protrude within this space about the internal combustion engine 20 of the present invention.

Since the high pressure oil switch 116 is arranged to protrude just below a part of the tank cover 88 covering the oil cooler 100 from its front side, its upper part is covered by the tank cover 88 to prevent water from dropping from above onto the high pressure oil switch 116.

Figure 17:
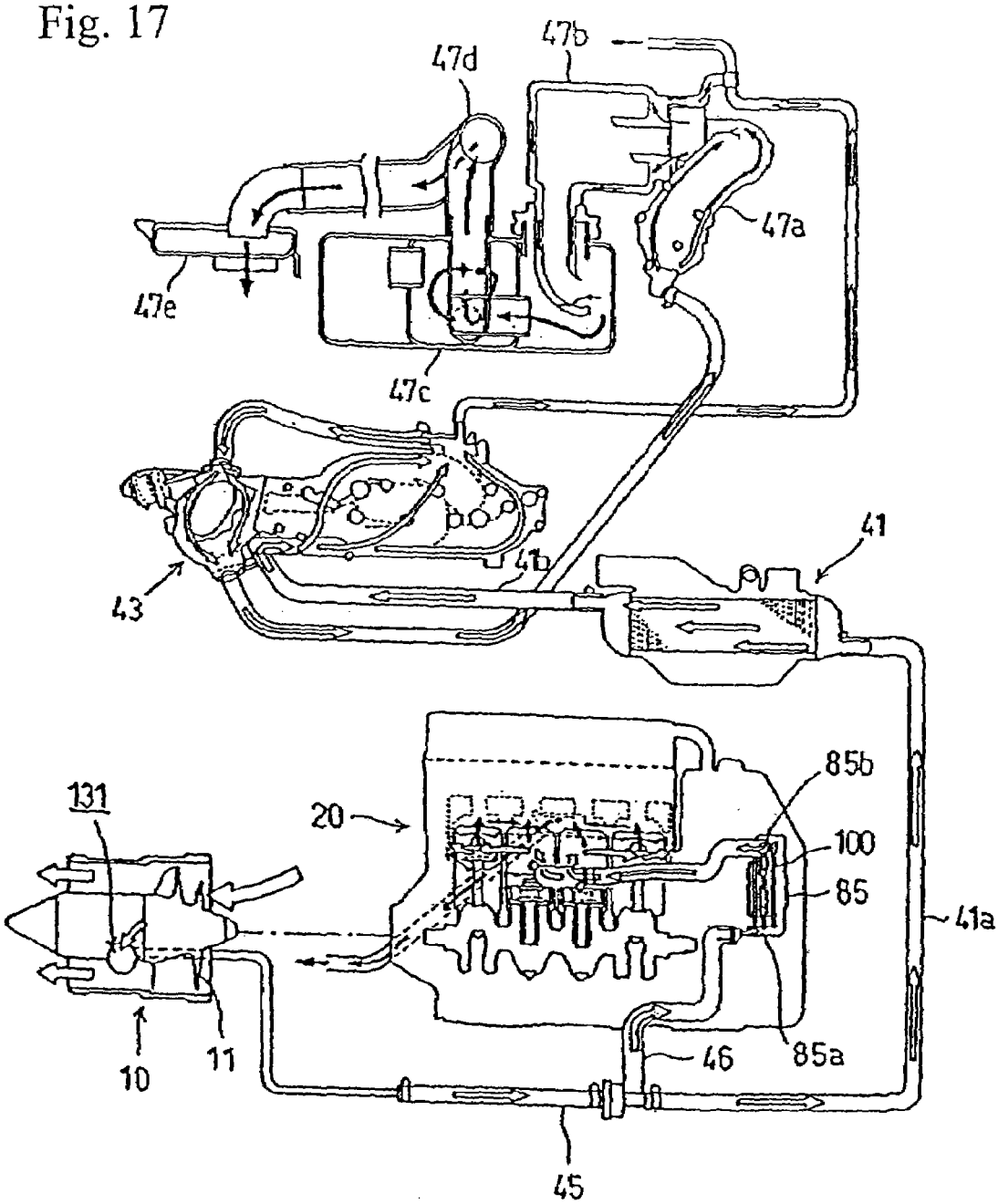
FIG. 17 is a diagram showing a circulation path of cooling water within the internal combustion engine of FIG. 1.

FIG. 17 illustrates the circulation path for the cooling water, wherein a relative height between the internal combustion engine 20 and the jet propulsion pump 10 is substantially illustrated in reference to its actual state. The crankshaft 21 and the rotating shaft of the impeller 11 are connected by the shaft 15 and they are also set substantially at the same height.

Referring to FIG. 17, as described above, the cooling water is taken through the cooling water intake port 131 at the downstream side positive pressure of the impeller 11 of the jet propulsion pump 10, and flows through the cooling water feeding hose 45 and the cooling water hose 46, and flows from the cooling water in-flow part 85*a* at the lower part of the oil cooler housing 85 to the oil cooler housing 85. The cooling water in-flow part 85*a* of the oil cooler housing 85 is located at a higher position than that of the crankshaft 21, and in turn, the cooling water intake port 131 at the positive pressure side of the jet propulsion pump 10 has a lower position than that of the crankshaft 21 kept at the same height position. The cooling water feeding hose 45 reaching the oil cooler housing 85, and all the cooling passages of the cooling water hose 46, are also located at a lower position than that of the cooling water in-flow part 85*a* at the lower part of the oil cooler housing 85.

Accordingly, when the personal watercraft 1 is pulled up on land, water in the oil cooler housing 85, covered by the tank cover 88, flows out of the cooling water in-flow part 85*a*, passes through the cooling water hose 46 and the cooling water feeding hose 45, flows out of the cooling water intake port 131 at the positive pressure side of the jet propulsion pump 10, and is naturally discharged.

While a working example of the present invention has been described above, the present invention is not limited to the working example described above, but various design alterations may be carried out without departing from the present invention as set forth in the claims.

What is claimed is:

1. An internal combustion engine for a personal watercraft, the personal watercraft comprising:

a vessel body which includes a hull and deck, the deck provided for supporting a crew thereon;

a jet propulsion pump housed within the vessel body;

the internal combustion engine being mounted in the vessel body of the personal watercraft within an interior space formed between the hull and the deck, and provided for driving the jet propulsion pump;

wherein the internal combustion engine comprises a crankcase, an oil pump and an oil pan, the oil pan connected to a lower surface of the crankcase at a lower portion of said engine, and arranged along a boat bottom of said hull;

the oil pan comprising a floor portion and a frame wall, the frame wall protruding upwardly in a substantially vertical direction from the floor portion, the frame wall defining a cavity therein which communicates with the oil pump;

the frame wall comprising a long side extending in a forward-and-rearward direction of the vessel body, the frame wall having an opening formed in the long side, and the oil pan further comprising an oil strainer arranged within said opening and oriented substantially vertically therein.

2. The internal combustion engine for a personal watercraft according to claim 1, wherein at least an upper surface at the top of said cavity is formed by a portion of said crankcase.

3. The internal combustion engine for a personal watercraft according to claim 2, wherein said oil strainer is held between said crankcase and the floor portion of the oil pan.

4. The internal combustion engine for a personal watercraft according to claim 1, wherein said internal combustion engine is mounted within the interior space of the vessel body so as to be inclined to a right side or to a left side of the vessel body, whereby the oil pan is also so inclined, and wherein the opening of the cavity, which has the oil strainer arranged therein, is formed at a lower side of the cavity within the oil pan.

5. The internal combustion engine for a personal watercraft according to claim 2, wherein said internal combustion engine is mounted within the interior space of the vessel body so as to be inclined to a right side or to a left side of the vessel body, whereby the oil pan is also so inclined, and wherein the opening of the cavity, which has the oil strainer arranged therein, is formed at a lower side of the cavity within the oil pan.

6. The internal combustion engine for a personal watercraft according to claim 3, wherein said internal combustion engine is mounted within the interior space of the vessel body so as to be inclined to a right side or to a left side of the vessel body, whereby the oil pan is also so inclined, and wherein the opening of the cavity, which has the oil strainer arranged therein, is formed at a lower side of the cavity within the oil pan.

7. The internal combustion engine for a personal watercraft according to claim 1, wherein said oil strainer comprises a border frame, a cover, and a screen, the screen being clamped between the border frame and the cover, the screen being tensioned by the border frame.

8. The internal combustion engine for a personal watercraft according to claim 7, wherein said cover is pyramidal in shape, with an apex of the pyramidal shape being offset toward the floor portion of the oil pan.

9. The internal combustion engine for a personal watercraft according to claim 1, wherein the oil pan further has an oil recovery path extending therein in a longitudinal direction of the vessel body, and wherein the frame wall further comprises a short side extending in a left-and-right direction of the vessel body, the frame wall short side opening to the oil recovery path.

10. The internal combustion engine for a personal watercraft according to claim 1, wherein the engine is a dry sump engine and further comprises an oil tank which is separate from said oil pan.

11. A personal watercraft, comprising:

a vessel body which includes a hull and deck, wherein the deck is adapted for supporting a crew thereon, a jet propulsion pump housed within the vessel body, and an internal combustion engine comprising a oil pump, a crankcase and an oil pan, the internal combustion engine being mounted in the vessel body of the personal watercraft within an interior space formed between the hull and the deck, and provided for driving the jet propulsion pump, the oil pan connected to the lower surface of the crankcase at a lower end of said engine, and arranged along a boat bottom of said hull, the oil pan comprising a floor portion and a frame wall, the frame wall protruding upwardly in a substantially vertical direction from the floor portion, the frame wall defining a cavity therein which communicates with the oil pump, the frame wall comprising a long side extending in a forward-and-rearward direction of the vessel body, the frame wall comprising an opening formed in the long side, and the oil pan further comprising an oil strainer arranged in said opening and oriented substantially vertically therein.

12. The personal watercraft according to claim 11, wherein at least an upper surface at the top of said cavity is formed by a portion of said crankcase.

13. The personal watercraft according to claim 11, wherein said oil strainer is held between said crankcase and the floor portion of the oil pan.

14. The internal combustion engine for a personal watercraft according to claim 1, wherein said internal combustion engine is mounted within the interior space of the vessel body so as to be inclined to a right side or to a left side of the vessel body, whereby the oil pan is also so inclined, and wherein the opening of the cavity, which has the oil strainer arranged therein, is formed at a lower side of the cavity within the oil pan.

15. The personal watercraft according to claim 11, wherein said oil strainer comprises a border frame, a cover, and a screen, the screen being clamped between the border frame and the cover, the screen being tensioned by the border frame.

16. The internal combustion engine for a personal watercraft according to claim 15, wherein said cover is pyramidal in shape, with an apex of the pyramidal shape being offset toward the floor portion of the oil pan.

17. The personal watercraft according to claim 11, wherein the oil pan further has an oil recovery path extending therein in a longitudinal direction of the vessel body, and wherein the frame wall further comprises a short side extending in a left-and-right direction of the vessel body, the frame wall short side opening to the oil recovery path.

* * * * *